US007249823B2

(12) United States Patent
Wong et al.

(10) Patent No.: US 7,249,823 B2
(45) Date of Patent: Jul. 31, 2007

(54) FLUID EJECTION DEVICE

(75) Inventors: Daniel Man-Tung Wong, Fremont, CA (US); Yen-Hui Ku, Taoyuan Hsin (TW)

(73) Assignee: MACRONIX International Co., Ltd., Hsinchu (TW)

( * ) Notice: Subject to any disclaimer, the term of this patent is extended or adjusted under 35 U.S.C. 154(b) by 233 days.

(21) Appl. No.: 10/709,717

(22) Filed: May 24, 2004

(65) Prior Publication Data

US 2005/0259131 A1 Nov. 24, 2005

(51) Int. Cl.
*B41J 2/04* (2006.01)
*B41J 2/05* (2006.01)

(52) U.S. Cl. ..... 347/54; 347/65

(58) Field of Classification Search ..... 347/20, 347/54, 56, 65

See application file for complete search history.

(56) References Cited

U.S. PATENT DOCUMENTS 6,274,056 B1 * 8/2001 Silverbrook ..... 216/27
6,299,290 B1 10/2001 Silverbrook ..... 347/54

* cited by examiner

*Primary Examiner*—An H. Do
(74) *Attorney, Agent, or Firm*—Jiang Chyun IP Office

(57) ABSTRACT

A fluid ejection device, a method and an operation method thereof are disclosed. The fluid ejection device includes a substrate, a beam and an activation pad. The substrate has an orifice, and the beam includes a fixed portion and a cantilever portion and is disposed over the substrate, wherein the cantilever portion is disposed over the orifice. Furthermore, the activation pad is disposed between the cantilever portion of the beam and the substrate. Because the fluid ejection device of the present invention is fabricated by using micro-electromechanical technology, and therefore it possible to obtain a fluid ejection device capable of ejecting the fluid from the orifice at a high-speed and also the quantity fluid ejected can be very small.

6 Claims, 7 Drawing Sheets

FLUID EJECTION DEVICE

BACKGROUND OF INVENTION

1. Field of the Invention

The present invention relates to a fluid ejection device, a fabrication method and an operating method thereof, adapted for an ink-jet printing head; and more particularly to a micro-electromechanical system (MEMS) fluid ejection device, a fabrication method and an operating method thereof.

2. Description of Related Art

To date, the ink-jet technology includes the bubble ink-jet technology and the piezoelectric ink-jet technology.

FIGS. 1A and 1B are schematic drawings showing an ink-jet head and an operation of the prior art bubble ink-jet technology. Referring to FIG. 1A, in the ink-jet head 100 adopted by the prior art bubble technology, the ink 104 is heated by a heater 102 for generating the bubble 106. Thereafter, the ink 104 is ejected from a nozzle 108 under the pressure of the bubble 106.

Referring to FIG. 1B, when the heater 102 stops heating, the bubble 106 in the ink 104 will not be inflated and remain flat as the result of cooling down. The surface tension of the ink 104 will create tensile force to pull back the ink 104. Accordingly, the operation of the thermal sensing ink-jet technology is performed. The printing speed of the bubble ink-jet technology is about micro-second level. The disadvantage is that the ink is easily ejected due to pressure and the ejection force of the ink cannot be controlled. The ink is adversely affected by law of inertia at the nozzle, resulting in non-uniformity or ink residuals. The other disadvantage is that, because the ink-jet head of the bubble ink-jet technology is usually under high temperature situation due to use of heater, and therefore the ink-jet head is easily damaged, especially in absence of ink therein.

FIGS. 2A-2C are schematic drawings showing an ink-jet head and an operation of the prior art piezoelectric ink-jet technology. Referring to FIG. 2A, the ink-jet head 200 of the prior art piezoelectric ink-jet technology uses a quartz crystal 202 to control the ejection of the ink 204. The ink-jet head 200 comprises a nozzle 208. When electricity is applied to the quartz crystal, the quartz crystal 202 generates a fixed oscillation frequency. When electricity applied to the quartz crystal is removed, the ink is pulled back.

Referring to FIG. 2B, when electricity is applied to the quartz crystal 202, the quartz crystal 202 expands and ejects the ink 204 from the nozzle 208. Because the piezoelectric ink-jet technology does not need thermal transformation, the damage the to ink-jet head due to thermal issue can be avoided.

Referring to FIG. 2C, when the supply of electricity to the quartz crystal is cut, the quartz crystal 202 shrinks to the original size for pulling the ink 204 back. The printing speed of the piezoelectric ink-jet technology is also about micro-second level. The problem is that it is not possible to further reduce the quantity of ejected ink.

SUMMARY OF INVENTION

Accordingly, the present invention is directed to a fluid ejection device, adapted for ejecting the fluid at a nano-second level speed and to precisely control the quantity of the fluid ejected thereby. The fluid ejection device is suitable for an ink-jet printer.

The present invention is also directed to a method of fabricating a fluid ejection device. The fabrication method is capable of further reducing the size of the fluid ejection device.

The present invention is also directed to a method of operating a fluid ejection device, which is capable of enhancing the fluid ejection speed and precisely controlling the quantity of the fluid rejected thereby.

According to an embodiment of the present invention, a fluid ejection device comprises a substrate, a beam and an activation pad. The substrate comprises an orifice. The beam is disposed over the substrate. The beam comprises a fixed portion and a cantilever portion, wherein the cantilever portion is disposed over the orifice. The activation pad is disposed between the cantilever portion of the beam and the substrate.

According to an embodiment of the present invention, a method of fabricating the fluid ejection device is provided. First, a substrate is provided. Next, an activation pad is formed on the substrate. Next, a patterned sacrificial layer is formed over the substrate covering the activation pad, the patterned sacrificial layer comprises an opening exposing a portion of the substrate there-within. A patterned mold layer comprising a trench is formed over the patterned sacrificial layer, wherein the trench positioned over the opening exposing the opening. Next, a first conductive layer is formed over the mold layer filling the opening and the trench. Next, a hole formed in a backside of the substrate. Thereafter, the patterned sacrificial layer and the patterned mold layer are removed. The first conductive layer constitutes a beam structure.

According to an embodiment of the present invention, a method of operating the fluid ejection device is provided. First, a fluid ejection device is provided. Next, the fluid ejection device is filled with a fluid. For ejecting the fluid out of the orifice, a voltage is applied to the activation pad, as a result, the cantilever portion of the beam is pulled down from an initial position toward the orifice and thereby ejecting the fluid out of the orifice. When the voltage applied to the activation pad is removed, the cantilever portion of the beam gradually moves away from the orifice.

According to an embodiment of the present invention, a micro-electromechanical structure is used for fluid ejection, and therefore the fluid ejection speed can be at a nano-second level and the fluid quantity ejected thereby can be precisely controlled. Moreover, according to an embodiment of the present invention, the micro-electromechanical technology is applied for fabricating the fluid ejection device, and therefore the size of the fluid ejection device can be effectively reduced and can be adapted for meeting the high resolution requirement of ink-jet printers. Additionally, a voltage is applied for controlling the fluid ejection instead of using a heater, and therefore damage attributed to the high temperature can be effectively avoided.

In order to make the aforementioned and other objects, features and advantages of the present invention understandable, a preferred embodiment accompanied with figures is described in detail below.

DETAILED DESCRIPTION

Figure 1A:
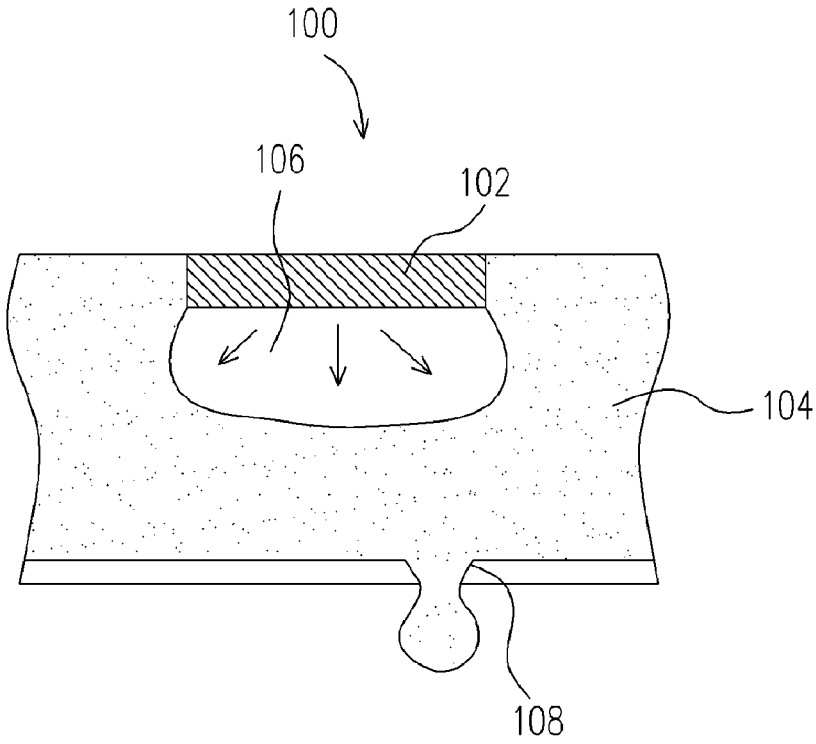
FIG. 1A(PRIOR ART)
FIGS. 1A and 1B are schematic drawings showing an ink-jet head and a method of operating a prior art bubble ink-jet device.
Figure 1B:
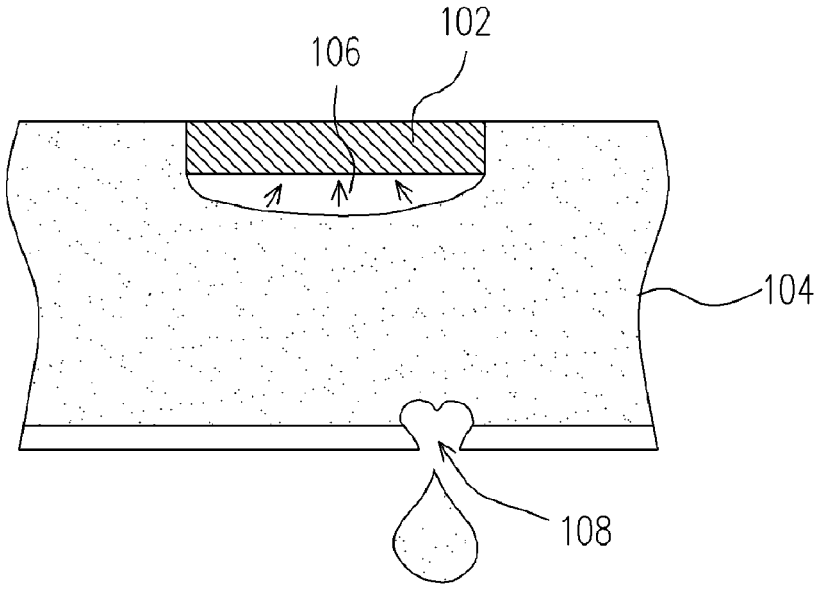
FIG. 1B(PRIOR ART)
Figure 2A:
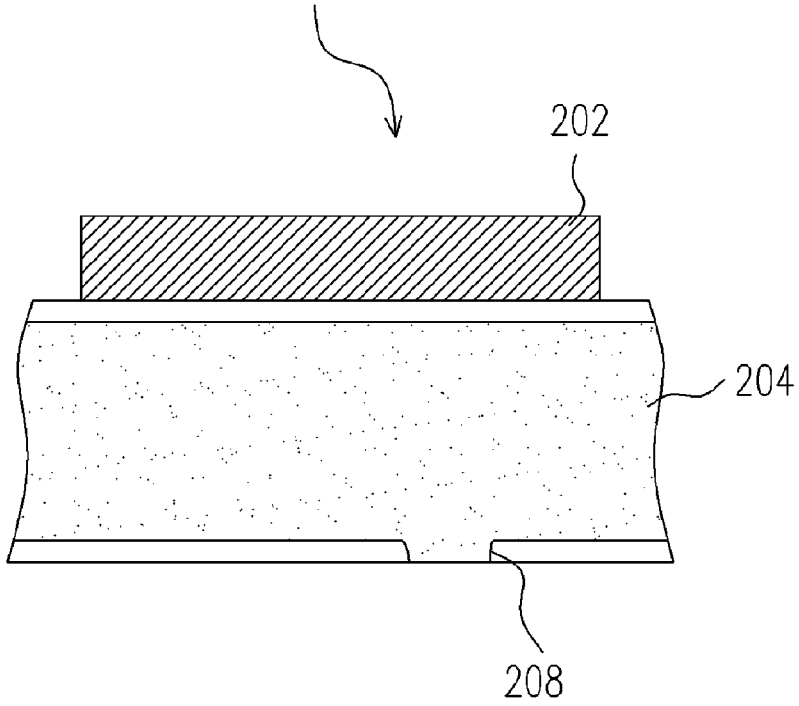
FIG. 2A(PRIOR ART)
FIGS. 2A-2C are schematic drawings showing an ink-jet head and a method of operating the prior art piezoelectric ink-jet device.
Figure 2B:
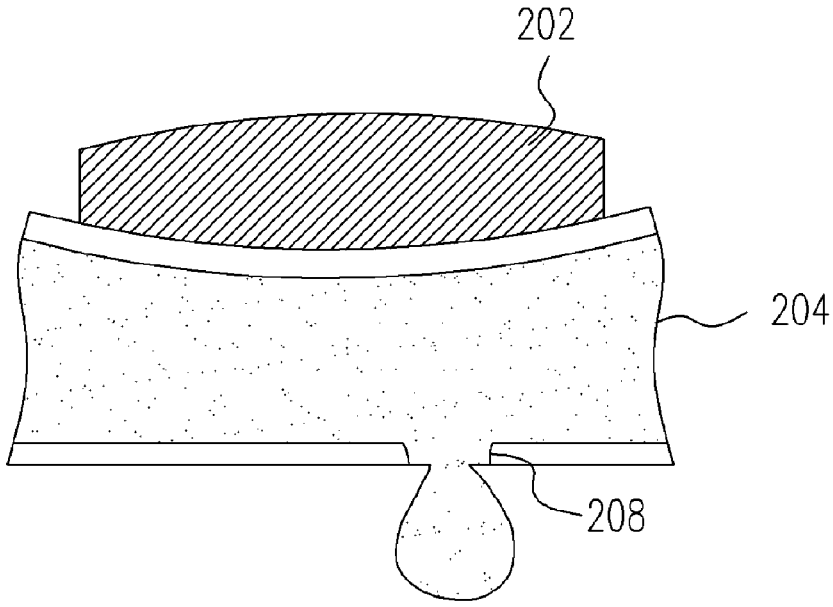
FIG. 2B(PRIOR ART)
Figure 2C:
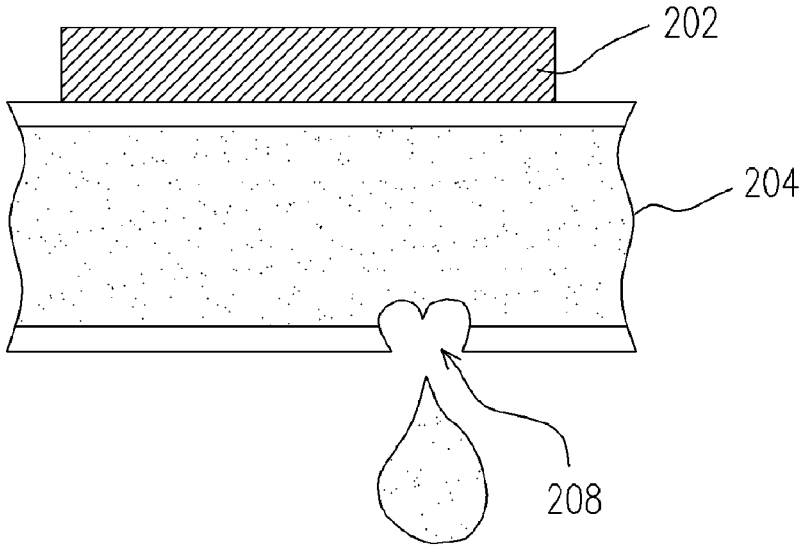
FIG. 2C(PRIOR ART)
Figure 3A:
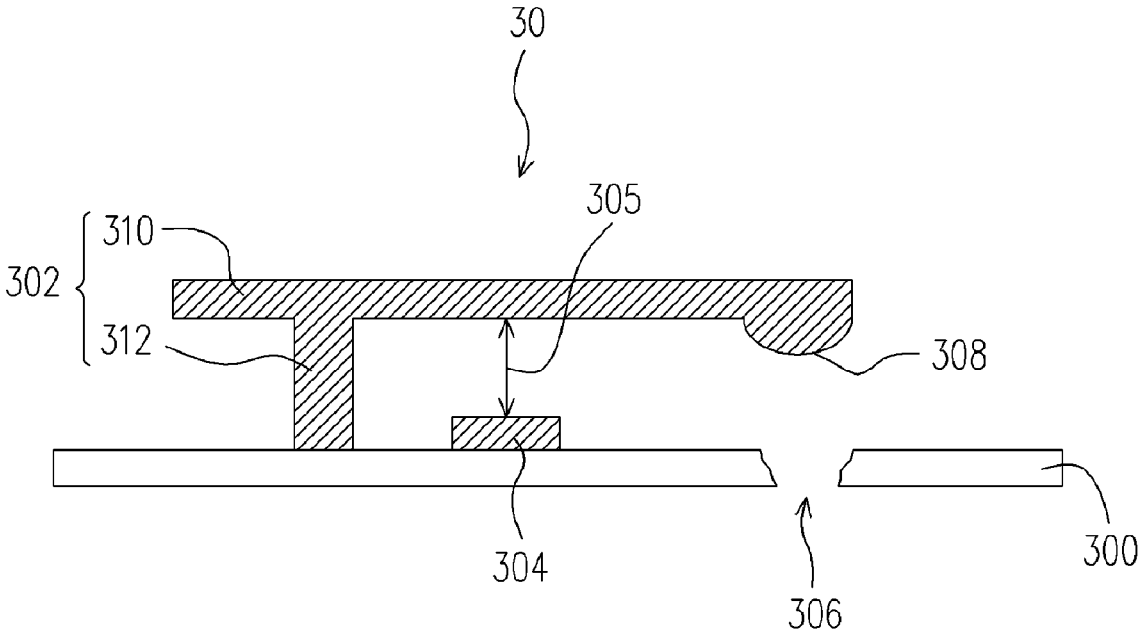
FIG. 3A is a cross-sectional view showing a fluid ejection device according to an embodiment of the present invention.
Figure 3B:
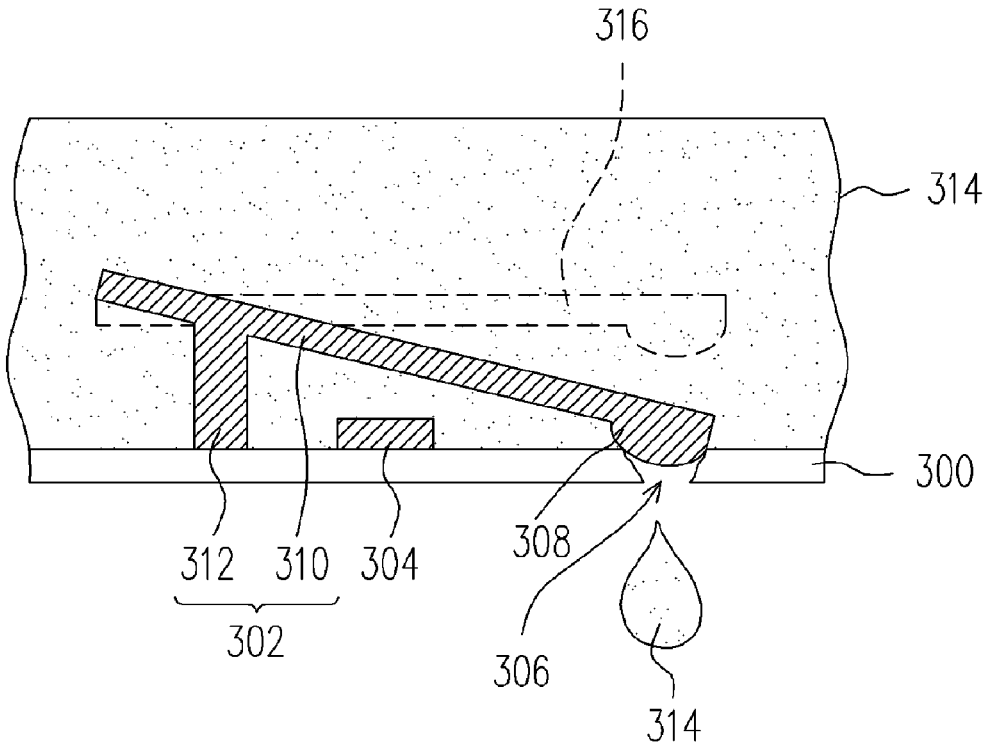
FIGS. 3B and 3C are schematic drawings showing a method of operating of the fluid ejection device of FIG. 3A according to an embodiment of the present invention.
Figure 3C:
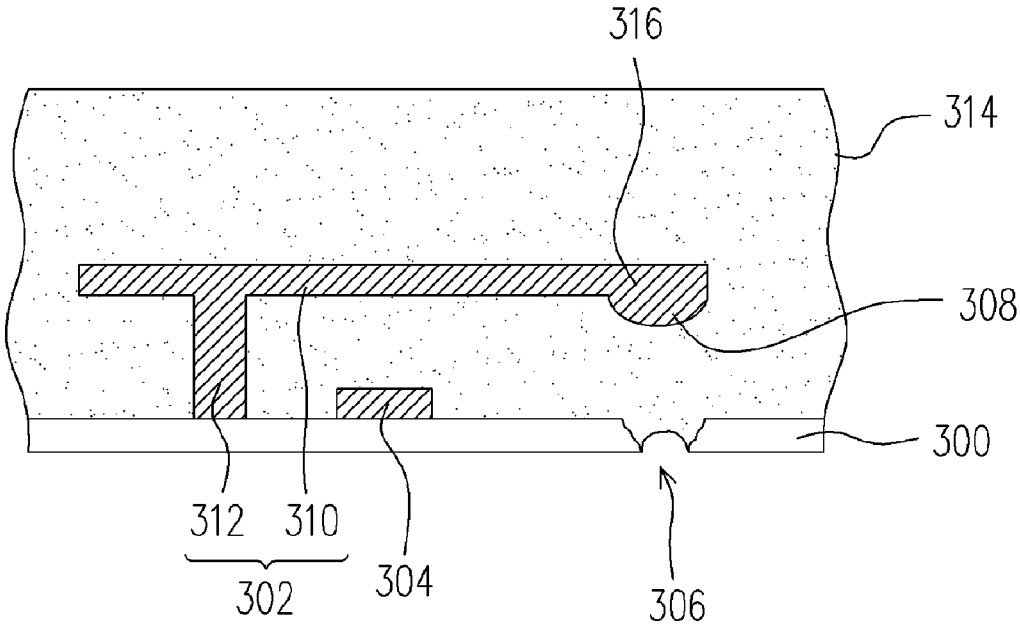

FIG. 3A is a cross-sectional view showing a fluid ejection device according to an embodiment of the present invention. FIGS. 3B and 3C are schematic drawings showing a method of operating the fluid ejection device of FIG. 3A according to an embodiment of the present invention.

Please referring to FIG. 3A, the exemplary fluid ejection device 30 comprises: a substrate 300, a beam 302 and an activation pad 304. The substrate 300 comprises an orifice 306 formed thereon. The beam 302 comprises a fixed portion 312 and a cantilever portion 310, wherein the cantilever portion 310 is disposed over and correspond to the orifice 306. The activation pad 304 is disposed between the cantilever portion 310 of the beam 302 and the substrate 300.

In an embodiment of the present invention, the fixed portion 312 is, for example, a pillar structure formed on the substrate 300 and is adapted for supporting the cantilever portion 310. The activation pad 304 on the substrate 300 is separated from the beam 302 by a distance 305. In another embodiment of the present invention, the fluid ejection device 30 further comprises a stopper 308, which is disposed on the cantilever portion 310 of the beam 302, and is aligned to the orifice 306 of the substrate 300. According to an embodiment of the present invention, the dimension of the stopper 308 can be larger than that of the orifice 306.

According to an embodiment of the present invention, the point of attachment on the cantilever portion 310 with the fixed portion 312 is such that a length ratio of a portion including the end with stopper 308 to the portion including the opposite end thereof on either side of the point of attachment is 4:1. For example, as shown in FIG. 3A, the length ratio of the portion cantilever portion 310 having the stopper 308 on the right side of the fixed portion 312 to the portion of the cantilever portion 310 the left side of the fixed portion 312 about 4:1. However, the ratio of the beam 302 of the present invention is not limited thereto. In addition, the material of the activation pad 304 and the beam 302 can be metal. It is preferred that it is a non-corrosive conductive metal, such as gold. In addition, the shape of the orifice 306 can be, for example, a funnel shape as shown in FIG. 3A, or the other suitable shape, such as cylindrical shape or bowl shape.

According to an embodiment of the present invention, the method of operating the fluid ejection device 30 for ejecting the fluid through the orifice of the ink-jet printing head will be described with reference to FIG. 3B. First, the fluid 314 is filled into the fluid ejection device 30. Then a voltage is applied to the activation pad 304 of the fluid ejection device 30. A voltage difference occurs between the activation pad 304 and the beam 302. As a result, the cantilever portion 310 of the beam 302 is pulled down from an initial position toward the orifice 306 for ejecting the fluid 314 out of the orifice 306.

When the voltage is applied to the activation pad 304 of the fluid ejection device 30, a corresponding voltage can be optionally applied to the beam 302 of the fluid ejection device 30 according to the practical design or requirement. In an embodiment, when the cantilever portion 310 of the beam 302 is pulled down, the stopper 308 on the cantilever portion 310 will stick to the orifice 306 for precisely controlling the fluid 314 ejected from the orifice 306.

Referring to FIG. 3C, when the voltage applied to the activation is removed, the cantilever portion 310 of the beam 302 moves away from the orifice 306 and return to, for example, to its original position 316. Meanwhile, the fluid 314 is pulled back and the fluid 314 will be maintained in the fluid ejection device 30 because of its viscosity.

The method of fabricating a fluid ejection device according to an embodiment to the present invention is described with reference to FIGS. 4A-4G. The fluid ejection device is fabricated by using the micro-electromechanical technology. FIGS. 4A-4G are cross-sectional views showing progression steps of the method of fabricating a fluid ejection device according to an embodiment of the present invention.

Figure 4A:
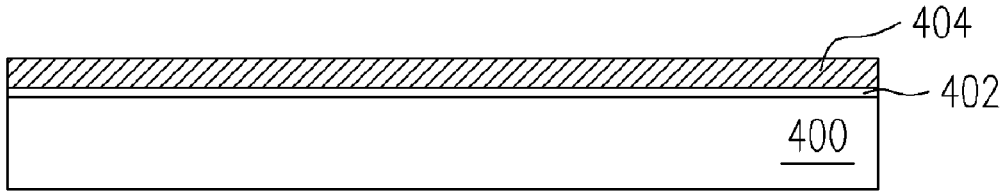
FIGS. 4A-4G are cross-sectional views showing a method manufacturing a fluid ejection device according to an embodiment of the present invention.

Referring to FIG. 4A, a substrate 400 is provided. An oxide layer 402 is formed on the substrate 400, and a conductive layer 404 is formed on the oxide layer 402. The method of forming the conductive layer 404 can be, for example, a sputtering process, and the material of the conductive layer 404 can be metal, such as gold.

Figure 4B:
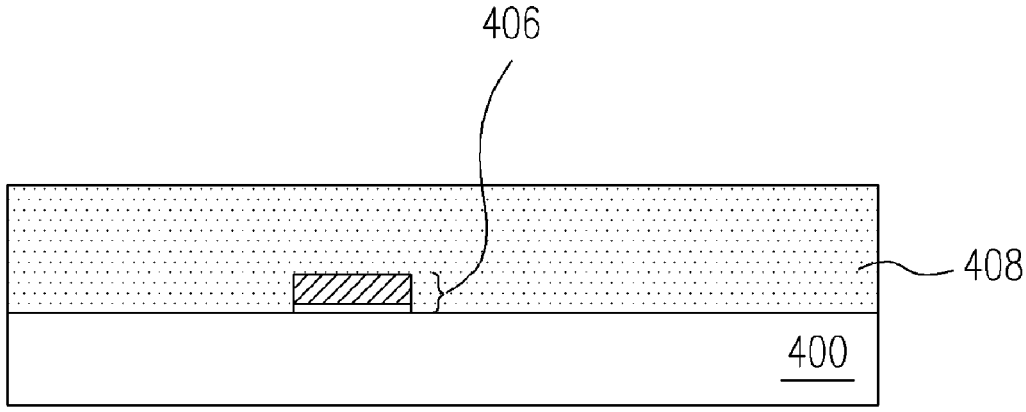

Referring to FIG. 4B, the conductive layer 404 and the oxide layer 402 are etched to form an activation pad 406. Next, a sacrificial layer 408 is formed over the substrate 400 covering the activation pad 406, wherein the thickness of the sacrificial layer 408 will determine the gap between the activation pad 406 and the subsequent beam. In an embodiment of the present invention, the thickness of the sacrificial layer 406 can be, for example, from about 4000 Å to about 6000 Å, and preferably about 5000 Å. The material of the sacrificial layer 408 can be, for example, photoresist or any other material having an etching selectivity different from conductive material.

Figure 4C:
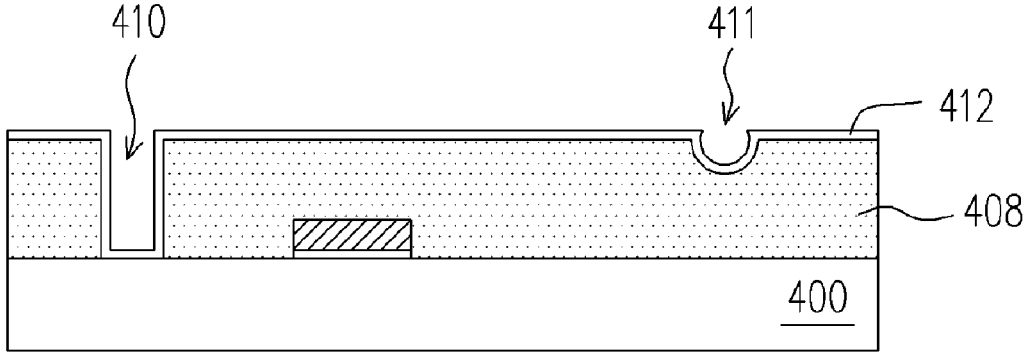

Referring to FIG. 4C, the sacrificial layer 408 is etched to form an opening 410 and an indentation 411 therein. In an embodiment of the present invention, the indentation 411 defines the subsequently formed stopper. Before performing the next process, it is optional to sputter a seed layer 412, such as Cr, Au or the combination thereof, on the surface of the patterned sacrificial layer 408, the indentation 411 and the sidewalls of the opening 410. The thickness of the seed layer 412 can be, for example, from about 800 Å to about 1200 Å, and preferably about 1000 Å.

Figure 4D:
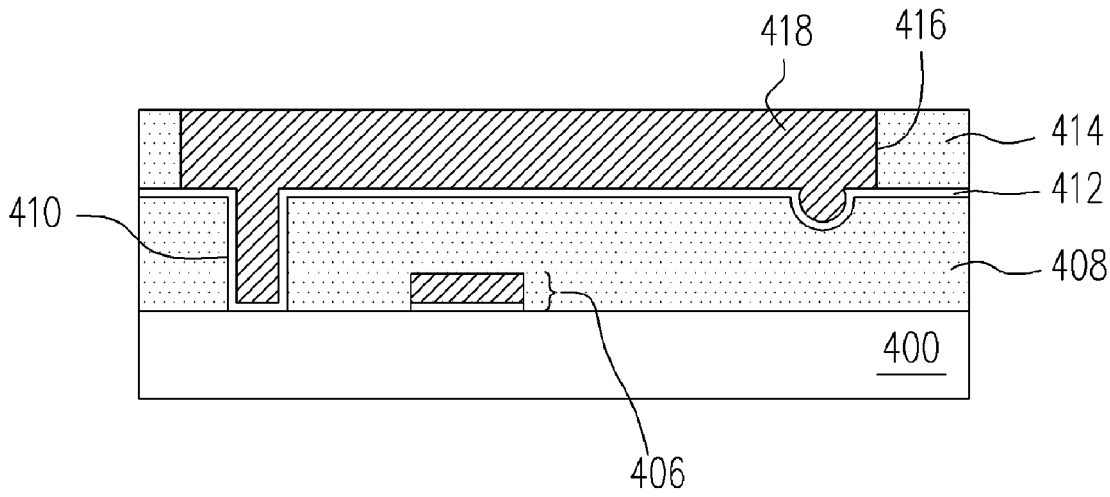

Referring to FIG. 4D, a patterned mold layer 414 is formed on the sacrificial layer 404, wherein the mold layer 414 comprises a trench 416 exposing the opening 410. In an embodiment of the present invention, the material of the mold layer can be, for example, same or similar to that of the sacrificial layer 408. Next, another conductive layer 418 is formed in the opening 410 and the trench 416. The method of forming the conductive layer 418 can be, for example, a sputtering method, and the material of the conductive layer 418 can be a metal, such as gold.

Figure 4E:
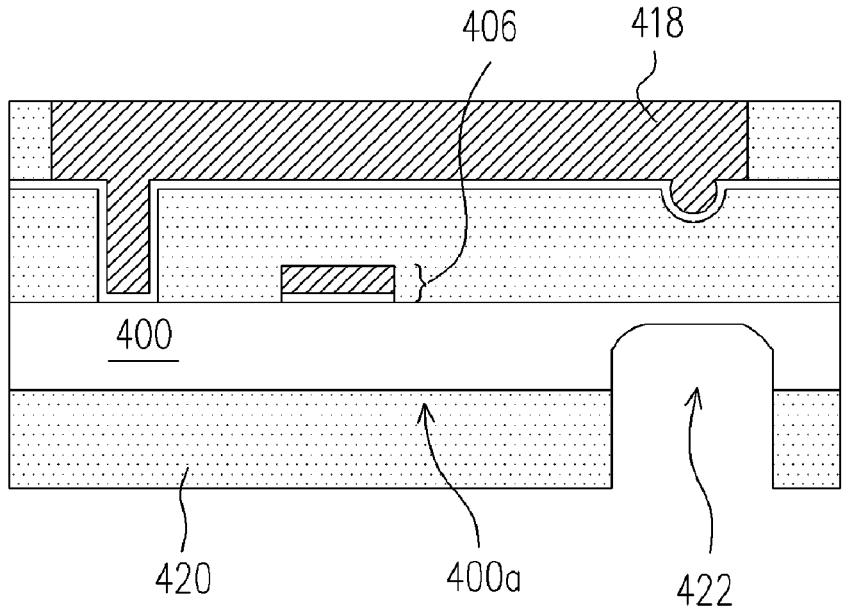

Referring to FIG. 4E, a first patterned mask layer 420 is formed on the backside **400*a* of the substrate 400. Next, an etching process is carried out to remove a portion of the substrate 400 exposed by the first patterned mask layer 420 using the first patterned mask layer 420 as an etching mask to form a notch 422**. For example, etching process can be a wet etching process using a solution containing, for example, KOH.

Figure 4F:
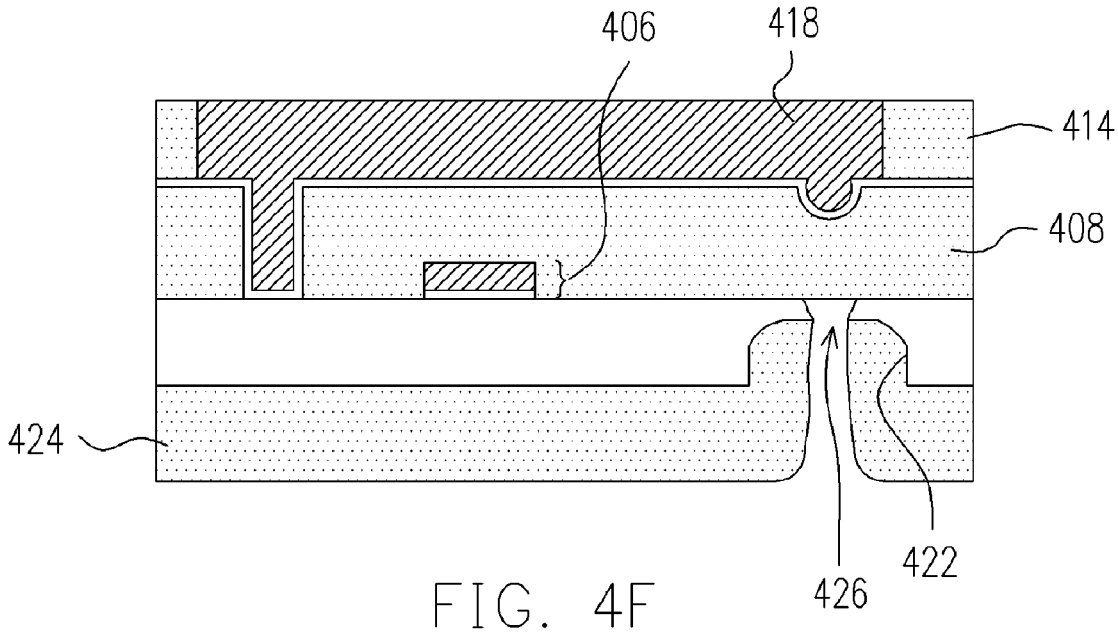

Referring to FIG. 4F, the first patterned mask layer 420 is removed. Next, a second mask layer 424 is formed on the backside **400*a* of the substrate 400 covering the sidewalls and a portion of the bottom of the notch such that a portion of the bottom of notch 422 is exposed. Next, an etching process is carried out using the second mask layer 424 as an etching mask to remove a portion of the substrate 400 until a portion of the sacrificial layer is exposed to form a hole 426**. The etching process can be, for example, a dry etching process.

According to another embodiment, the second mask layer 424 can be formed on the first patterned mask layer 420 without removing the first patterned mask layer 420. Thereafter, the etching process can be carried out to form the hole 426 through the substrate 400.

According to another embodiment of the present invention, the hole 426 can be formed by directly forming a patterned mask layer (not shown) on the backside 400*a* of the substrate 400 for exposing a portion of the substrate 400. Thereafter, an etching process is carried out to form the hole 426 through the backside 400*a* using the mask layer as an etching mask layer.

Figure 4G:
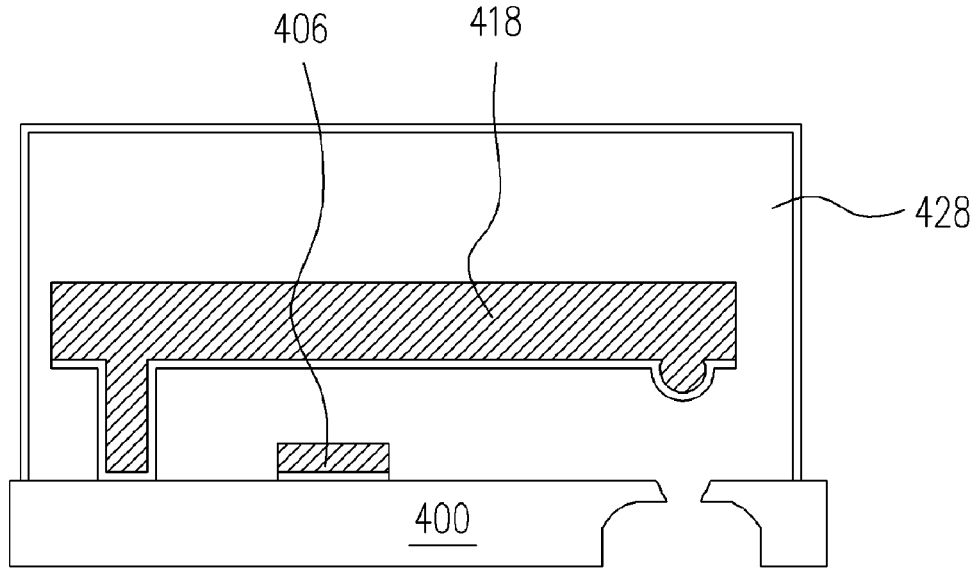

Referring to FIG. 4G, the sacrificial layer 408 and the mold layer 414 are removed and the conductive layer 418 constitutes the beam structure. Noticeably, the materials of the mask layers 422 and 426 are similar to those of the sacrificial layer 408 and the mold layer 414, and accordingly, the mask layers 422 and 426 can be removed simultaneously. The substrate 400 is encapsulated to form an encapsulation structure 428 covering the activation pad and the conductive layer 418. The method of encapsulating the substrate 400 includes a frit glass seal method or a thermal compression method.

Accordingly, the micro-electromechanical technology is applied to fabricate the fluid ejection device. Therefore, the size of the fluid ejection device can substantially reduced such the fluid ejection can be at a nano-second level speed and the quantity of the fluid ejected can be precisely controlled.

According to an embodiment of the present invention, the micro-electromechanical technology is applied to fabricate the fluid ejection device so that the size of the fluid ejection device can be substantially reduced.

Moreover, a voltage applied to control the fluid ejection instead of using a heater, and therefore damage attributed to the high temperature due to heater can be effectively avoided.

Although the present invention has been described in terms of exemplary embodiments, it is not limited thereto. Rather, the appended claims should be constructed broadly to include other variants and embodiments of the invention which may be made by those skilled in the field of this art without departing from the scope and range of equivalents of the invention.

The invention claimed is:

1. A fluid ejection device suitable for an ink-jet printer, comprising:

a substrate, having an orifice;

a beam, disposed over the substrate, the beam having a fixed portion and a cantilever portion, wherein the cantilever portion is disposed over the orifice;

an activation pad, disposed between the cantilever portion of the beam and the substrate, wherein the activation pad is disposed apart from the beam; and a stopper, disposed on an end of the cantilever portion and protruded from the cantilever portion of the beam and aligned to the orifice of the substrate, wherein at least a portion of the stoppers fits into the orifice when the cantilever portion of the beam is pulled down.

2. The fluid ejection device of claim 1, wherein a dimension of the stopper is larger than that of the orifice.

3. The fluid ejection device of claim 1, wherein the fixed portion of the beam is a collar structure disposed on the substrate for supporting the cantilever portion.

4. The fluid ejection device of claim 1, further comprising an encapsulation structure covering the substrate for encapsulating the beam and the activation pad.

5. A method of operating a fluid ejection device, comprising:

providing the fluid ejection device of claim 1;

providing a fluid;

filling the fluid into the fluid ejection device;

wherein when a voltage is applied to the activation pad resulting in a voltage difference occurring between the activation pad and the beam, the cantilever portion of the beam is pulled down from an initial position toward the orifice of the substrate resulting in the stopper sticking to the orifice for ejecting the fluid out of the orifice and at least a portion of the stopper fitting into the orifice; and wherein when the voltage applied to the activation pad is removed, the cantilever portion of the beam gradually moves away from the orifice.

6. The method of operating a fluid ejection device of claim 5, wherein when the voltage applied to the activation pad is removed, the cantilever portion of the beam gradually moves away from the orifice.

* * * * *